US012188471B2

(12) United States Patent
Asfoor

(10) Patent No.: US 12,188,471 B2
(45) Date of Patent: Jan. 7, 2025

(54) LUBRICANT SYSTEM FOR A COMPRESSOR

(71) Applicant: Johnson Controls Tyco IP Holdings LLP, Milwaukee, WI (US)

(72) Inventor: Firas Gassan Asfoor, Plano, TX (US)

(73) Assignee: Tyco Fire & Security GmbH, Neuhausen am Rheinfall (CH)

( * ) Notice: Subject to any disclaimer, the term of this patent is extended or adjusted under 35 U.S.C. 154(b) by 0 days.

(21) Appl. No.: 17/787,004

(22) PCT Filed: Dec. 16, 2020

(86) PCT No.: PCT/US2020/065394
§ 371 (c)(1),
(2) Date: Jun. 17, 2022

(87) PCT Pub. No.: WO2021/242311
PCT Pub. Date: Dec. 2, 2021

(65) Prior Publication Data

US 2023/0086482 A1 Mar. 23, 2023

Related U.S. Application Data

(60) Provisional application No. 62/949,333, filed on Dec. 17, 2019.

(51) Int. Cl.

| | |
|---|---|
| ***F04C 18/16*** | (2006.01) |
| ***F04C 29/00*** | (2006.01) |
| ***F04C 29/02*** | (2006.01) |

(52) U.S. Cl.
CPC ..... *F04C 18/16* (2013.01); *F04C 29/0021* (2013.01); *F04C 29/023* (2013.01); *F04C 2240/603* (2013.01)

(58) Field of Classification Search
CPC .... F04C 18/16; F04C 29/0021; F04C 29/023; F04C 2240/603
See application file for complete search history.

(56) References Cited

U.S. PATENT DOCUMENTS 3,811,805 A 5/1974 Moody, Jr. et al.
3,922,114 A * 11/1975 Hamilton ..... F04C 29/045 417/372
4,375,156 A 3/1983 Shaw

FOREIGN PATENT DOCUMENTS

DE 2329799 A1 2/1974
WO 2019083778 A1 5/2019

OTHER PUBLICATIONS

Machine Translation and WIPO publication WO 2008/019815; Inventor: FRIEDRICHSEN; Title: Rotor Cooling for Dry-Running Twin-Shaft Vacuum Pumps or Compressors; Published: Feb. 21, 2008. (Year: 2008).*

(Continued)

*Primary Examiner* — Mary A Davis
(74) *Attorney, Agent, or Firm* — Fletcher Yoder, P.C.

(57) ABSTRACT

A system includes a compressor housing having an intake portion and a discharge portion and a rotor disposed in the compressor housing and configured to compress a fluid flowing from the intake portion toward the discharge portion. The rotor includes a body portion and an internal passageway formed within the body portion extending along an axial length of the rotor. The internal passageway is configured to direct a lubricant between the intake portion and the discharge portion of the compressor housing.

13 Claims, 6 Drawing Sheets

(56) References Cited

OTHER PUBLICATIONS

Machine Translation and Foreign Patent Publication for JP 3240851 B2 : First Inventor: TSURU; Title: Dry Screw Fluid Machine; Published Dec. 25, 2001. (Year: 2001).*
PCT International Search Report and Written Opinion for PCT Application No. PCT/US2020/065394, mailed Jan. 21, 2022, 15 pgs.
European Office Action for EP Application No. 20930667.9, dated Jul. 24, 2024, 7pages.

* cited by examiner

LUBRICANT SYSTEM FOR A COMPRESSOR

CROSS-REFERENCE TO RELATED APPLICATIONS

This application is a U.S. National Stage Application of International Application No. PCT/US2020/065394, entitled "LUBRICANT SYSTEM FOR A COMPRESSOR," filed Dec. 16, 2020, which claims priority to and the benefit of U.S. Provisional Application No. 62/949,333, entitled "LUBRICANT SYSTEM FOR A COMPRESSOR," filed Dec. 17, 2019, each of which is hereby incorporated by reference in its entirety for all purposes.

BACKGROUND

The present disclosure relates generally to compressors, and more particularly, to screw compressors for heating, ventilating, air conditioning, and refrigeration (HVAC&R) systems.

Heating, ventilation, air conditioning, and refrigeration (HVAC&R) systems typically maintain temperature control in a structure or other controlled space by circulating a fluid (e.g., refrigerant) through a circuit via a compressor to exchange thermal energy with another fluid (e.g., water and/or air). One type of compressor that may be utilized in the HVAC&R system is a screw compressor, which generally includes one or more cylindrical rotors mounted inside a hollow casing. Twin screw compressor rotors typically have helically extending lobes (or flutes) and grooves (or flanks) on their outer surfaces that form a thread about the circumference of the rotor. During operation, the threads of the rotors mesh together, with the lobes on one rotor meshing with the corresponding grooves on the other rotor to form a series of gaps between the rotors. The gaps form a continuous compression chamber that communicates with a compressor inlet or port and continuously reduces a volume of the fluid as the rotors turn to compress the fluid. To improve performance of the compressor, lubricant may be directed into the compressor for cooling, lubrication, and/or sealing. In some cases, lubricant may mix with fluid in the compressor, which may reduce an efficiency of the HVAC&R system.

SUMMARY

In one embodiment, a system includes a compressor housing having an intake portion and a discharge portion and a rotor disposed in the compressor housing and configured to compress a fluid flowing from the intake portion toward the discharge portion. The rotor includes a body portion and an internal passageway formed within the body portion extending along an axial length of the rotor. The internal passageway is configured to direct a lubricant between the intake portion and the discharge portion of the compressor housing.

In another embodiment, a system includes a compressor having a compressor housing that includes an intake portion, a discharge portion, a lubricant inlet port, and a lubricant drain port, and a rotor disposed in the compressor housing and configured to compress a fluid flowing from the intake portion toward the discharge portion. The rotor includes a body, lobes and/or grooves configured to contact the fluid during compression, and a passageway extending internally through the body along an axial length of the rotor and through at least portions of the intake portion and discharge portion of the compressor housing. The passageway is configured receive lubricant from the lubricant inlet port and direct the lubricant to the lubricant drain port In an another embodiment, a system includes a compressor that includes a compressor housing having an intake portion and a discharge portion, a first rotor disposed in the compressor housing and a second rotor disposed in the compressor housing. The first rotor includes a first body portion and a first passageway extending along a first axial length of the first rotor, where the first passageway is configured to direct a lubricant between the intake portion and the discharge portion of the compressor housing. The second rotor includes a second body portion and a second passageway extending through the second body portion along a second axial length of the second rotor, where the second passageway is configured to direct the lubricant between the intake portion and the discharge portion of the compressor housing. The first rotor and the second rotor are configured to rotate and engage with one another to compress a fluid flowing from the intake portion toward the discharge portion.

DRAWINGS

DETAILED DESCRIPTION

Figure 1:
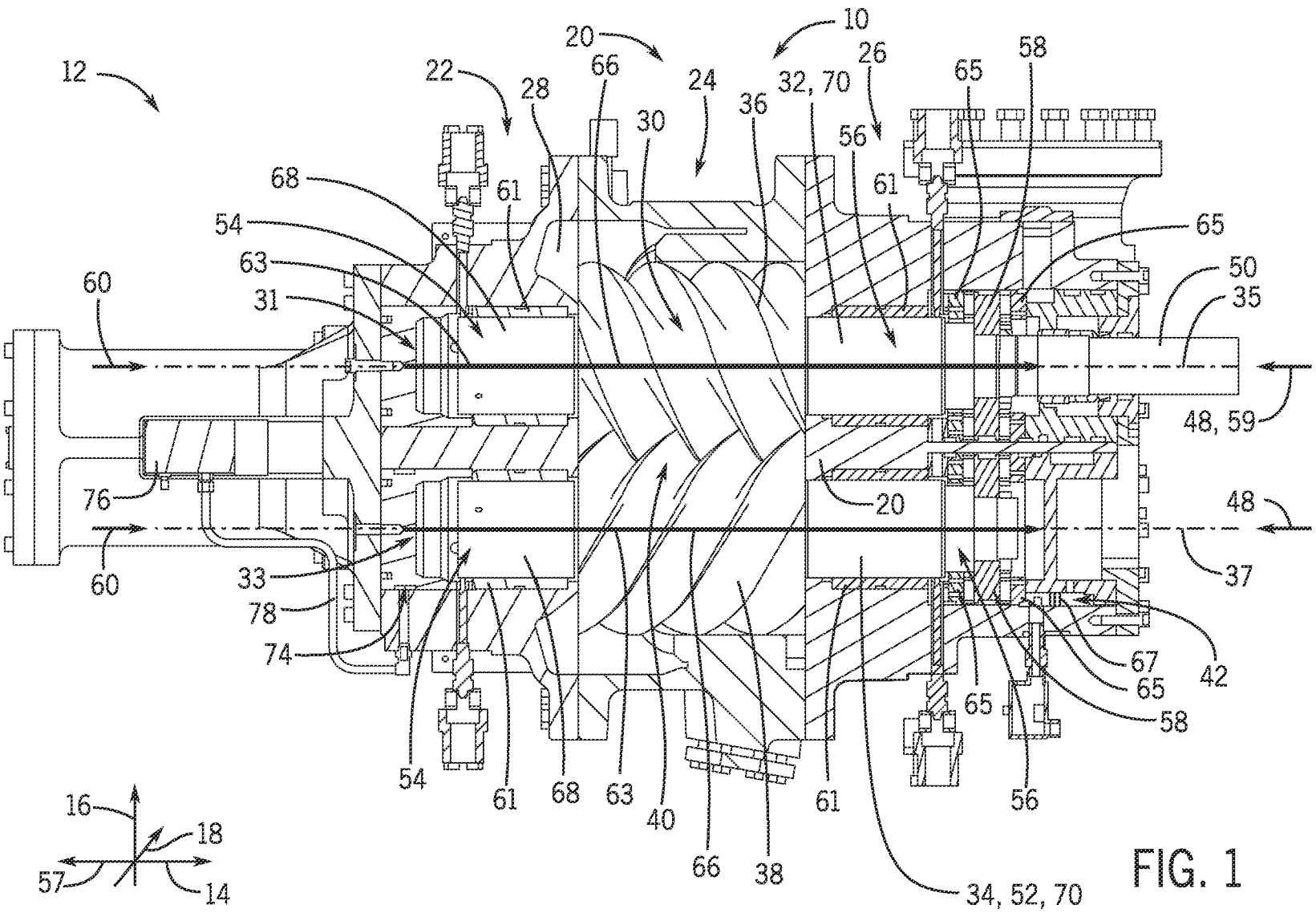
FIG. 1 is a cross-sectional view of an embodiment of a compressor that may be used in a heating, ventilation, air conditioning, and/or refrigeration (HVAC&R) system, in accordance with an aspect of the present disclosure.

One or more specific embodiments of the present disclosure will be described below. These described embodiments are only examples of the presently disclosed techniques. Additionally, in an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

A heating, ventilation, air conditioning, and/or refrigeration (HVAC&R) system may include a vapor compression system having a compressor (e.g., a screw compressor) that is configured to circulate a fluid through a circuit. The compressor may include one or more rotors mounted on one or more shafts and disposed inside a rotor housing. Bearings (e.g., ball bearings, journal bearings, thrust bearings) engage the one or more shafts to facilitate rotation of the rotors during operation of the compressor. To reduce wear on the bearings and increase efficiency of the compressor, a lubricant (e.g., oil) is directed into the rotor housing. The lubricant may provide cooling, reduce friction between moving components, and/or seal portions of the compressor. Typically, the lubricant is provided from a lubricant source and is directed into an intake portion of the rotor housing via ports extending into the rotor housing. The lubricant provided to the intake portion flows through the rotor housing to lubricate various components of the compressor and then flows toward a discharge portion of the rotor housing. In existing systems, lubricant may mix with fluid flowing through the compressor, which may reduce an efficiency of the HVAC&R system. Accordingly, embodiments of the present disclosure are configured to reduce an amount of lubricant that may flow through a compression chamber of the compressor by directing the lubricant through passageways extending through the rotors and toward various components of the compressor (e.g., bearings).

Operation of the compressor may generate a pressure differential between the compressor inlet (e.g., suction side) and the compressor outlet (e.g., discharge side), which may impose an axial force on the rotors of the compressor (e.g., a force applied in an axial direction from the discharge port toward the suction port). In some embodiments, a bearing, such as a thrust bearing, may be radially coupled to a shaft of a rotor of the compressor and may function to block axial movement (e.g., axial vibrations) of the rotor. In some cases, the axial force imparted on the thrust bearing during operation of the compressor may cause the thrust bearing to incur wear. In some cases, a balance piston may be used to apply a counter-force to the rotor that is opposite in direction to the axial force. Unfortunately, balance pistons may increase the costs and complexity of the compressor. Therefore, to improve the operational life of the thrust bearing, embodiments of the present disclosure may direct a lubricant (e.g., oil) toward an end of the rotor (e.g., an end proximate the intake portion or suction side of the compressor) so that the lubricant may apply the counter-force to the rotor and increase an operating life of the thrust bearing. Additionally or alternatively, the lubricant may be directed through passageways extending through the rotor toward the thrust bearing to provide the counter-force to the rotor of the screw compressor with the lubricant. In still further embodiments, the passageway may be configured to receive the lubricant from the thrust bearing and direct the lubricant toward the discharge portion or the intake portion of the compressor.

In a typical screw compressor, lubricant is provided to both the intake portion and the discharge portion of the rotor housing via a lubricant source. For example, conduits external to the rotor housing may supply the lubricant from the lubricant source to lubricant ports of the rotor housing. As should be understood by those of skill in the art, screw compressors may generate pulses or vibrations during operation, which may increase wear incurred by conduits that direct the lubricant from the lubricant source to the compressor. Thus, it may be desirable to reduce or limit an amount of conduits that are utilized to direct lubricant to the rotor housing. In some embodiments of the present disclosure, the compressor is configured to receive lubricant via a port in one of the intake portion or the discharge portion. The lubricant may flow from the intake portion toward the discharge portion, or vice versa, through passageways formed within and extending through the rotor in order to provide a counter-force, as well as provide cooling, lubrication, and/or sealing to various components of the compressor. The inclusion of internal passageways within the rotors to transfer lubricant may reduce the usage of external conduits and/or other lubricant ports to transfer lubricant to and through the compressor. Because fewer ports and conduits are utilized, wear on various components incurred from pulses or vibrations may be reduced. As such, including the lubricant passageway within one or more rotors of the compressor may increase efficiency of the compressor, decrease wear on thrust bearings, and/or reduce maintenance costs of the compressor.

Turning now to the drawings, FIG. 1 illustrates a cross-sectional view of an embodiment of a compressor 10 that may be used in a vapor compression system. To facilitate discussion, the compressor 10 and its components may be described with reference to a longitudinal axis or direction 14, a vertical axis or direction 16, and a lateral axis or direction 18. It should be noted that the vertical axis 16 and the lateral axis 18 extend in radial directions relative to the longitudinal axis 14. The compressor 10 includes a compressor housing 20 that contains working components (e.g., bearings) of the compressor 10. As described in greater detail herein, the compressor housing 20 may include an intake portion 22 (e.g., suction side), a compression portion 24 (e.g., compression chamber), and a discharge portion 26 (e.g., discharge side).

In some embodiments, the intake portion 22 includes an intake port 28 configured to receive a fluid from a fluid circuit having the compressor. The fluid (e.g., a gaseous refrigerant) from the vapor compression system may be drawn into the intake port 28 to enter a compression chamber 30 of the compressor portion 24 via the intake port 28. The compressor 10 includes a male rotor 32 and a female rotor 34, which may rotate about a first axis 35 and a second axis 37, respectively. The male rotor 32 and the female rotor 34 each extend from at least the intake portion 22 to the discharge portion 26 in a direction substantially parallel to the longitudinal axis 14, such that the first axis 35 and the second axis 37 also extend parallel to the longitudinal axis 14. The male rotor 32 includes one or more protruding lobes 36 disposed circumferentially about the male rotor 32. Similarly, the female rotor 34 includes one or more corresponding grooves 38 disposed circumferentially about the female rotor 34 that are configured to receive and/or engage with the lobes 36 of the male rotor 32.

The lobes 36 of the male rotor 32 may mesh with the corresponding grooves 38 on the female rotor 34 to form a series of gaps 40 between the rotors 32, 34. The gaps 40 may continuously compress fluid (e.g., the refrigerant) entering the compressor 10 via the intake port 28 and may direct compressed fluid toward a discharge port 42 of the discharge portion 24. For example, during operation of the compressor 10, the gaps 40 may continuously reduce in volume as the rotors 32, 34 rotate and thereby compress the fluid along the length of the rotors 32, 34 from the intake port 28 to the discharge port 42. The compressed fluid (e.g., vapor refrigerant) may exit the compression chamber 30 through the discharge port 42 to flow out of the compressor 10.

During operation of the compressor 10, an axial force 48 may be imposed on a first shaft 50 of the male rotor 32 and/or on a second shaft 52 of the female rotor 34. The axial force 48 may be generated due to a pressure differential between a first end portion 54 of the rotors 32, 34 (e.g., near the intake port 28) and a second end portion 56 of the rotors 32, 34 (e.g., near the discharge port 42). For example, a first pressure of the fluid acting on components within the compressor 10 at the intake port 28 may be substantially less (e.g., 2 times less, 20 times less, or more) than a second pressure of the fluid acting on the components within the compressor 10 at the discharge port 42. Accordingly, a difference between the second pressure and the first pressure may generate the axial force 48, which may be applied to the rotors 32, 34 in a direction 57 toward the intake portion 22 of the compressor housing 20. In some embodiments, the male rotor 32 may be configured to drive (e.g., rotate) the female rotor 34 (e.g., rotation of the shaft of the female rotor 34 is not driven by a motor or external drive). For example, the lobes 36 (e.g., helical lobes) of the male rotor 32 may engage with the grooves 38 (e.g., helical grooves) of the female rotor 34, such that rotation of the male rotor 32 may induce rotation of the female rotor 34. The female rotor 34 may resist rotation (e.g., due to the pressure differential between the end portions 54, 56 of the rotors 32, 34, inertia, etc.) and may thus impose an axial thrust 59 on the male rotor 32. The axial thrust 59 may act in the direction 57 and may therefore increase a magnitude of the axial force 48 imposed on the male rotor 32.

In some embodiments, the axial force 48 may be transmitted to one or more bearings, such as a thrust bearing 58, which is radially disposed about the first shaft 50 of the male rotor 32 and/or the second shaft 52 of the female rotor 34. While the illustrated embodiment of FIG. 1 shows the compressor 10 having one thrust bearing 58 associated with the male rotor 32 and one thrust bearing 58 associated with the female rotor 34, it should be noted that the compressor 10 may include two, three, four, five, six, seven, eight, nine, ten, or more thrust bearings 58 disposed about (e.g., adjacent to one another) one or both of the rotors 32, 34. The thrust bearing 58 may counter-act a substantial portion of the axial force 48, such that the axial force 48 does not induce damage to certain compressor 10 components. However, application of the axial force 48 may reduce an operational or useful life of the thrust bearing 58 due to excess forces imposed on the thrust bearing 58. In some embodiments, the thrust bearing 58 may be an axial contact ball bearing, a four-point ball bearing, a tilt pad thrust bearing, or another suitable bearing configured to at least partially counter-act the axial force 48.

In some embodiments, a force application device, such as a balance piston may be disposed within a portion of the compressor housing 20 (e.g., the intake portion 22) and may be configured to impose a regulating force 60 (e.g., a counter-force) on the first shaft 50, the second shaft 52, or both. However, in other embodiments, the compressor 10 may be a sleeve bearing compressor that includes a tilt pad thrust bearing, and thus, may not include a balance piston. Typically, the thrust bearing 58 (e.g., a tilt pad thrust bearing) of a sleeve bearing compressor supports a substantial amount of a load applied by the axial force 48. In some embodiments, lubricant 63 may be utilized to reduce a portion of the axial force 48 applied to the thrust bearing 58. For example, the lubricant 63 may be directed toward an end 31 of the male rotor 32 and an end 33 of the female rotor 34 to apply the regulating force 60 to the rotors 32 and 34, and thus reduce a portion of the axial force 48 applied to the thrust bearing 58. That is, the lubricant 63 may apply pressure to the ends 31 and/or 33 of the rotors 32 and/or 34 proximate the intake portion 22. The pressure of the lubricant 63 (e.g., the regulating force 60) is configured to counteract the axial force 48, which may increase an operational or useful life of the thrust bearing 58.

The lubricant 63 may be directed into the compressor housing 20 at the intake portion 22 of the compressor 10. For example, in the illustrated embodiment, the compressor housing 20 includes a lubricant inlet port 74 that is configured to receive the lubricant 63 from a conduit 78 fluidly coupled to a lubricant supply 76. From the lubricant inlet port 74, the lubricant 63 is directed toward a lubricant passageway that is located within the intake portion 22 of the compressor housing 20. The lubricant passageway may direct the lubricant 63 toward sleeve bearings 61 that are disposed about the male rotor 32 and/or the female rotor 34 of the compressor 10 within the intake portion 22. As will be appreciated, the sleeve bearings 61 are configured to block radial movement (e.g., movement along the vertical axis 16 and/or the lateral axis 18) of the male rotor 32 and/or the female rotor 34 in the compressor housing 20. In some embodiments, the compressor 10 may additionally or alternatively include one or more mechanical bearings 65 (e.g., ball bearings, roller bearings, journal bearings) that are configured to block radial movement of the male rotor 32 and/or the female rotor 34 in the compressor housing 20. The sleeve bearings 61, the mechanical bearings 65, and/or other suitable bearings of the compressor 10 may receive the lubricant 63 from the lubricant passageway during operation to reduce friction between the sleeve bearings 61, the mechanical bearings 65, and/or other suitable bearings of the compressor 10 and the rotors 32 and 34 as the rotors 32 and 34 rotate to compress the fluid.

In accordance with present embodiments, the lubricant passageway is also fluidly coupled to a passageway 66 formed in (e.g., internally formed within) at least one of the male rotor 32 and the female rotor 34. The passageway 66 (e.g., internal passageway) provides a flow path for the lubricant 63 received by fluid passageway at the intake portion 22 of the compressor 10. As shown in the illustrated embodiment of FIG. 1, the male rotor 32 and the female rotor 34 each include the passageway 66 formed in a body portion 68 of the male rotor 32 and a body portion 68 of the female rotor 34, and the passageways 66 extend along the first axis 35 and second axis 37. In this way, the passageways 66 provide a flow path for the lubricant 63 (e.g., oil) from the intake portion 22 to the discharge portion 26 of the compressor 10 in a single flow direction. In operation, lubricant 63 received by the intake portion 22 (e.g., that is not directed to the sleeves 61 and/or other bearings positioned within, or positioned proximate to, the intake portion 22) may flow through the passageways 66 extending through the rotors 32, 34 toward the discharge portion 26 of the compressor 10. Within the discharge portion 26, the lubricant 63 may be directed toward the sleeves 61 and/or the mechanical bearings 65 positioned within, or positioned proximate to, the discharge portion 26. In this way, lubricant 63 may be utilized to reduce friction between components within the discharge portion 26 and the male rotor 32 and/or the female rotor 34. In some embodiments, the passageway 66 includes multiple outlets that direct the lubricant 63 toward components of the compressor 10, such that the components receive a sufficient amount of the lubricant 63 to enable desired or improved operation of the compressor 10. Used and/or excess lubricant 63 may then be directed out of the compressor 10 via a lubricant drain port 67 positioned proximate the discharge portion 26.

While the illustrated embodiment includes the lubricant inlet port 74 positioned at the intake portion 22 and the lubricant drain port 67 positioned at the discharge portion 26, it should be appreciated that other variations of the compressor 10 may also include rotors 32, 34 with the passageway 66 formed therein for transfer of lubricant 63 from the intake portion 22 to the discharge portion 26 and vice versa. For example, lubricant inlet ports 74 may be included proximate to both the intake portion 22 and the discharge portion 26 or may be included proximate to the discharge portion 26, but not proximate to the intake portion 22. Similarly, in certain embodiments, the lubricant drain port 67 may be positioned proximate one or both of the intake portion 22 and the discharge portion 26. Lubricant 63 received by the intake portion 22 or the discharge portion 26 may then be transferred to the opposite end of the compressor 10 via the passageway 66 formed in and extending along the rotors 32, 34 in order to supply the lubricant 63 to the various components of the compressor 10. It will be appreciated that the use of lubricant inlet ports 74 in one of the intake portion 22 and the discharge portion 26 of the compressor housing 20 may enable a reduction in the amount of conduits 78 supplying the lubricant 63 to the compressor 10. As noted above, reducing the amount or number of conduits 78 may reduce wear caused by forces that are associated with vibration of the compressor 10 during operation.

Directing the lubricant 63 through the passageways 66 may also increase the operational efficiency of the compressor 10. For example, the lubricant 63 may flow through the intake portion 22 and into the passageway 66 extending through and along the male rotor 32 and/or the female rotor 34 instead of flowing into the compression chamber 30. Enabling the lubricant 63 to bypass the compression chamber 30 (e.g., by directing the lubricant 63 through the passageway 66) increases the efficiency of the HVAC&R system by reducing mixing of the lubricant 63 with fluid or other working fluid in the compression chamber 30. With less or no lubricant 63 mixed with the fluid within the compressor 10, and therefore within other portions of the vapor compression system, more efficient operation of the vapor compression system is enabled. For example, features or operations typically included with the compressor 10 separate lubricant 63 from fluid may not be utilized or may be utilized to a lesser degree.

Figure 2:
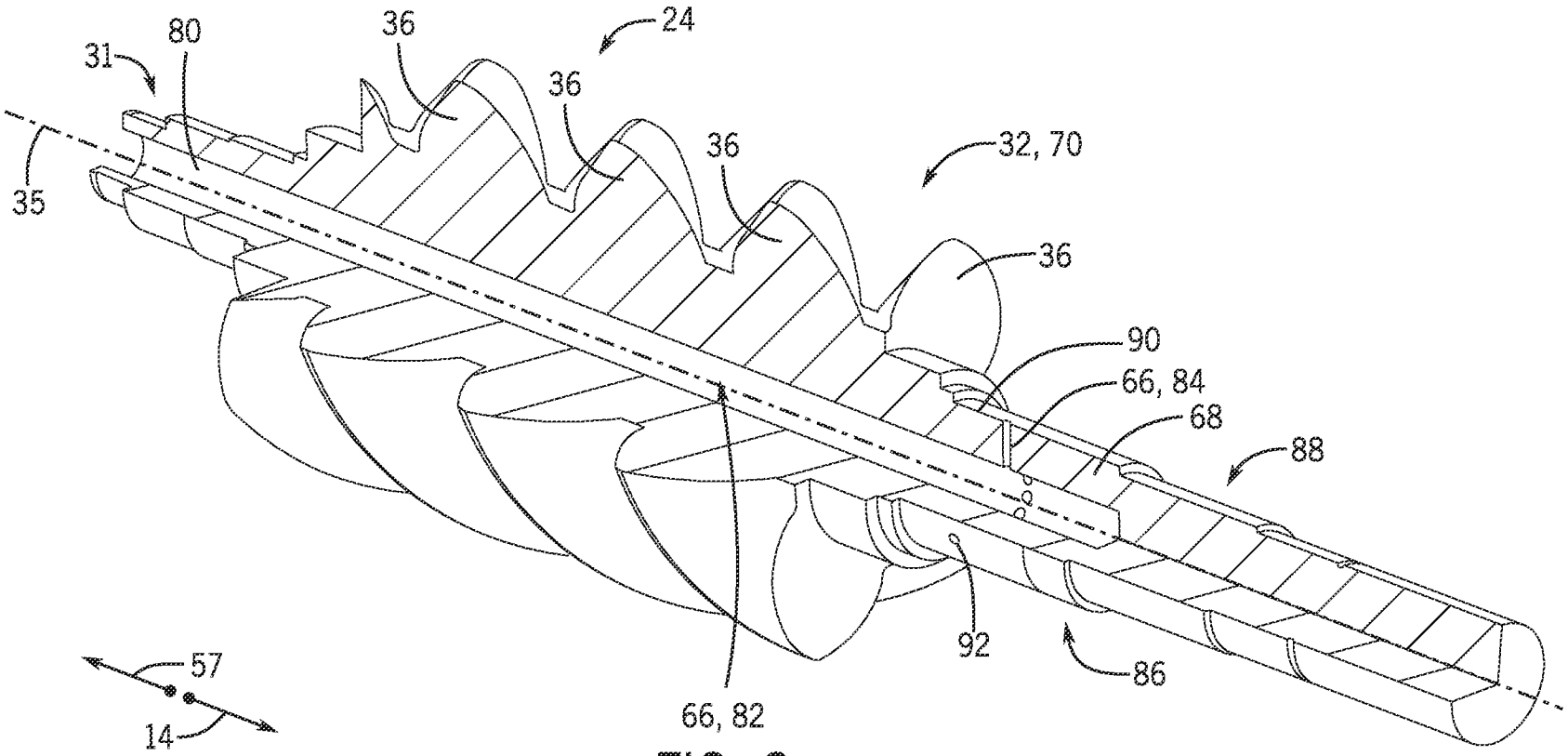
FIG. 2 is a partial sectional view of an embodiment of a male rotor that may be utilized in a compressor, in accordance with an aspect of the present disclosure.

FIG. 2 is a section view of an embodiment of the male rotor 32, which may be utilized in the compressor 10 of FIG. 1, in accordance with an aspect of the present disclosure. The male rotor 32 includes the body portion 68 and one or more of the lobes 36 (e.g., protruding lobes) disposed circumferentially about the male rotor 32. The lobes 36 may extend radially outward from the first axis 35 (e.g., central axis) of the body portion 68 toward the compression portion 24 of the compressor 10. As set forth above, the lobes 36 on the male rotor 32 may mesh with corresponding grooves 38 of the female rotor 34 (FIG. 3) to form the gaps 40 between the rotors 32 and 34. The gaps 40 may continuously compress fluid (e.g., refrigerant) within the compression portion 24 of the compressor 10 as the rotors 32 and 34 rotate about the axes 35 and 37, respectively.

The male rotor 32 also includes the passageway 66 formed within (e.g., internally within) the body portion 68, and the passageway 66 extends along the first axis 35 (e.g., rotational axis) of the male rotor 32. The passageway 66 includes at least one channel 80 extending through the body portion 68 of the male rotor 32. The passageway 66 is configured to fluidly couple the intake portion 22 and the discharge portion 26 of the compressor 10 with respect to a flow of the lubricant 63. In particular, the passageway 66 enables the lubricant 63 to flow between the intake portion 22 and the discharge portion 26 of the compressor 10. Additionally, in an installed and operational configuration of the male rotor 32 within the compressor housing 20, the passageway 66 is not directly fluidly coupled to the compression portion 24. As a result, an amount of the lubricant 63 flowing directly into the compression portion 24 is reduced.

The passageway 66 may include an axial portion 82 and one or more radial portions 84. In some embodiments, the axial portion 82 of the passageway 66 may extend partially through the body portion 68 along the first axis 35 of the male rotor 32. In the illustrated embodiment of FIG. 2, the axial portion 82 extends from the end 31 of the male rotor 32 to a portion 86 of the male rotor 32 between the compression portion 24 and a discharge end 88 of the male rotor 32. The end 31 may be disposed proximate to and/or within the intake portion 22 of the compressor housing 20, and the discharge end 88 may be disposed proximate to and/or within the discharge portion 26 of the compressor housing 20. In some embodiments, the axial portion 82 may extend from the discharge end 88 toward a portion of the male rotor 32 between the compression portion 24 and the end 31 of the male rotor 32. Additionally, in some embodiments, the axial portion 82 may have a constant diameter (e.g., having a substantially consistent diameter measurement within typical tolerances for forming or measuring such features) extending from the end 31 to the portion 86. However, in other embodiments, the axial portion 82 has a variable diameter between the end 31 and the portion 86. Further, the axial portion 82 may be coaxial with the first axis 35 (e.g., central axis) of the male rotor 32, which may maintain or balance a center of mass of the male rotor 32 proximate to the first axis 35 (i.e., the axis of rotation of the male rotor 32). As such, a torque utilized to rotate the male rotor 32 to a desired angular velocity may be reduced and/or maintained at a level that is similar or substantially equal to that of an embodiment of the male rotor 32 without the passageway 66. In other embodiments, the axial portion 82 may be offset from the first axis 35 of the body portion 68 of the male rotor 32. Additionally or alternatively, the body portion 68 and/or the lobes 36 of the male rotor 32 may have a semi-hollow structure (e.g., a plurality of cavities or webs within the body portion 68 and/or the lobes 36). The passageway 66 may form at least a portion of the semi-hollow structure of the body portion 68 to enable the lubricant 63 to flow between the end 31 and the discharge end 88 of the male rotor 32.

The one or more radial portions 84 of the passageway 66 may be fluidly coupled to the axial portion 82 and may extend radially outward from the axial portion 82 through an exterior surface 90 of the male rotor 32. The one or more radial portions 84 may include one or more openings 92 that direct the lubricant 63 from the axial portion 82 toward the sleeves 61, the one or more mechanical bearings 65, and/or other suitable components of the compressor 10. The one or more openings 92 may be positioned proximate to and/or within the discharge portion 26 of the compressor housing 20, such that the one or more radial portions 84 direct the lubricant 63 toward the discharge portion 26, and ultimately out of the compressor 10 via the lubricant drain port 67. While the illustrated embodiment of FIG. 2 shows the radial portions 84 disposed at a single axial position of the male rotor 32 with respect to the first axis 35, it should be noted that, in other embodiments, the one or more radial portions 84 may be positioned at any suitable position along the first axis 35 of the male rotor 32.

In some embodiments, the one or more radial portions 84 have a smaller diameter than the diameter of the axial portion 82 of the passageway 66. The various dimensions of the passageway 66 may be configured to maintain a generally uniform flow rate of the lubricant 63 through the male rotor 32. In such embodiments, a cumulative cross-sectional area of the one or more radial portions 84 may be substantially equal to a cross-sectional area of the axial portion 82 of the passageway 66. In some embodiments, the one or more radial portions 84 may be spaced or arrayed evenly about the external surface 90 of the male rotor 32. For example, a first radial portion may extend radially outward from the first axis 35 at a first angular position, and a second radial portion (e.g., adjacent to the first radial portion) may be angularly offset from the first radial portion by a target amount or angular dimension (e.g., 20 degrees). Further, a third radial portion (e.g., adjacent to the second radial portion) may be angularly offset from the second radial portion by the target amount or angular dimension (e.g., 20 degrees). In other words, adjacent radial portions of the one or more radial portions 84 may be angularly offset from one another by the target amount (e.g., 20 degrees), such that the one or more openings 92 are uniformly distributed about a circumference of the male rotor 32. In other embodiments, the one or more radial portions 84 may not include a uniform angular offset from one another, such that the corresponding one or more openings 92 are unevenly spaced about the circumference of the male rotor 32. In still further embodiments, the one or more radial portions 84 may be both radially and axially offset from one another. For example, the one or more radial portions 84 may be positioned at different axial locations along the body portion 68 with respect to the first axis 35 to direct the lubricant 63 toward different components (e.g., the sleeves 61 and/or the mechanical bearings 65) positioned at different axial positions within the compressor housing 20.

Figure 3:
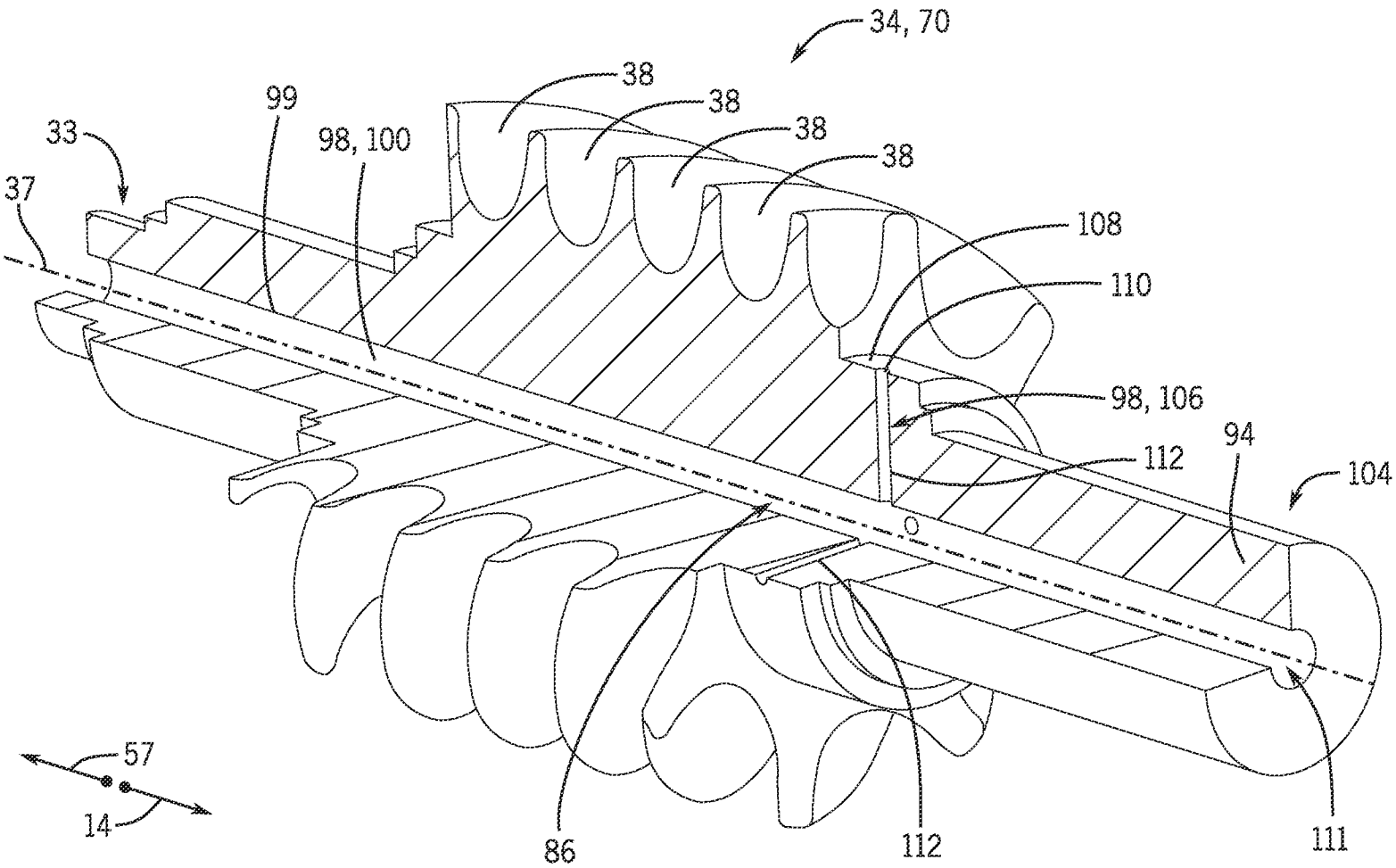
FIG. 3 is a partial sectional view of an embodiment of a female rotor that may be utilized in a compressor, in accordance with an aspect of the present disclosure.

FIG. 3 is a section view of an embodiment of the female rotor 34, which may be utilized with the compressor 10 of FIG. 1. As shown in the illustrated embodiment, the female rotor 34 includes a second body portion 94 with the grooves 38 disposed circumferentially about the female rotor 34. The grooves 38 may mesh with corresponding lobes 36 of the male rotor 32 to form the series of gaps 40 between the female rotor 34 and the male rotor 32. During operation, the gaps 40 may continuously compress fluid within the compression portion 24 of the compressor 10 as the rotors 32 and 34 rotate about the axes 35 and 37, respectively.

Similar to the male rotor 32, the female rotor 34 includes a second passageway 98 (e.g., passageway 66) extending along the second axis 37 (e.g., central axis, rotational axis) of the female rotor 34. The second passageway 98 may include at least one channel 99 extending through (e.g., internally within) the second body portion 94 of the female rotor 34. The second passageway 98 is also configured to fluidly couple the intake portion 22 and the discharge portion 26 of the compressor 10 with respect to the flow of the lubricant 63. Accordingly, the lubricant 63 (e.g., oil) may flow between the intake portion 22 and the discharge portion 26 of the compressor 10 without entering the compression portion 24. To this end, in an installed and operational configuration of the female rotor 34, the second passageway 98 is not directly fluidly coupled to the compression portion 24, such that an amount of the lubricant 63 flowing directly into the compression portion 24 is reduced.

The second passageway 98 may include a second axial portion 100 extending through the entire second body portion 94 of the female rotor 34 with respect to the second axis 37. For example, the second passageway 98 may extend from the end 33 of the female rotor 34 to a second discharge end 104 of the female rotor 34. The end 33 may be disposed proximate to and/or within the intake portion 22 of the compressor 10 in an installed configuration, and the second discharge end 104 may be disposed proximate to and/or within the discharge portion 26 of the compressor 10. In some embodiments, the second axial portion 100 of the female rotor 34 may have a constant diameter extending from the end 33 to the second discharge end 104. In other embodiments, the second axial portion 100 has a variable diameter between the end 33 and the second discharge end 104. Further, the second axial portion 100 may be coaxial with the second axis 37 of the female rotor 34, which may maintain or balance a center of mass of the female rotor 34 proximate to the second axis 37 (i.e., the axis of rotation of the female rotor 34). As such, a torque utilized to rotate the female rotor 34 to a desired angular velocity may be reduced and/or maintained at a level that is similar or substantially equal to an embodiment of the female rotor 34 without the second passageway 98.

In some embodiments, the second passageway 98 includes one or more second radial portions 106. The one or more second radial portions 106 of the second passageway 98 may be fluidly coupled to the second axial portion 100 and may extend radially outward from the second axial portion 100 through a second exterior surface 108 of the second body portion 94. The one or more second radial portions 106 may include corresponding radial openings 110 that direct lubricant 63 from the second axial portion 100 toward the sleeves 61, the mechanical bearings 65, and/or other suitable components of the compressor 10. The one or more second radial portions 106 may be disposed in the discharge portion 26 of the compressor housing 20, such that the one or more second radial portions 106 of the second passageway 98 fluidly couple the second passageway 98 to the discharge portion 26 of the compressor 10. While the illustrated embodiment of FIG. 3 shows the one or more second radial portions 106 positioned proximate to the second discharge end 104 of the female rotor 34, it should be noted that, in other embodiments, the one or more second radial portions 106 may be positioned at any suitable position along the second axis 37 of the female rotor 34. In some embodiments, both the one or more second radial portions 106 and the second axial portion 100 are configured to connect the second passageway 98 to the discharge portion 26 of the compressor housing 20. That is, the lubricant 63 may flow into a first area of the discharge portion 26 via the one or more second radial portions 106, and the lubricant 63 may flow into a second area of the discharge portion 26 via an outlet 111 of the second axial portion 100. The first and second areas of the discharge portion 26 may both include the components (e.g., the sleeves 61 and/or the mechanical bearings 65) of the compressor 10 that receive and utilize the lubricant 63. In other embodiments, the second axial portion 100 may not extend through the entire length of the second body portion 94 of the female rotor 34. As such, the lubricant 63 may be directed toward the discharge portion 26 via the one or more second radial portions 106.

Figure 4:
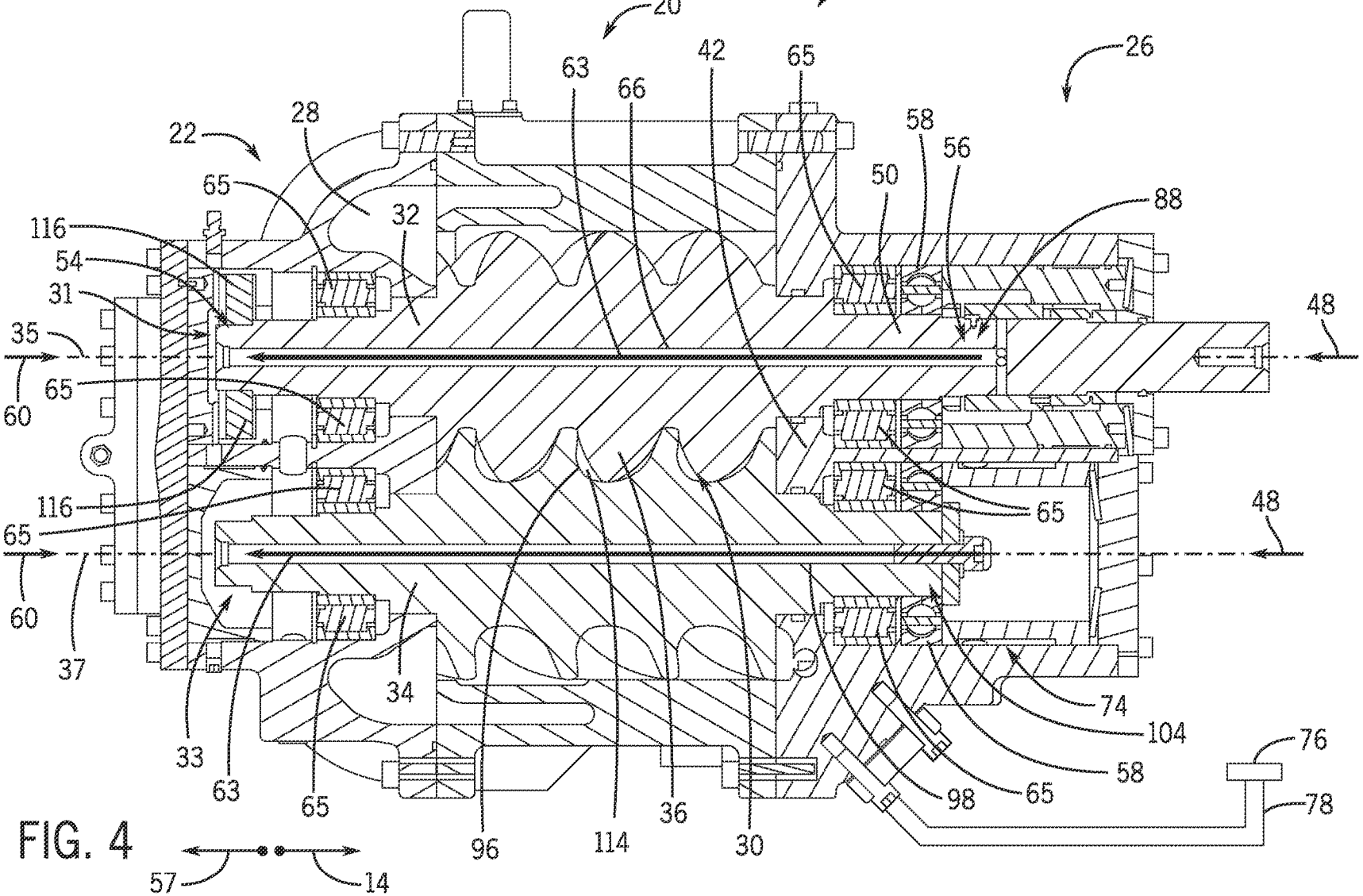
FIG. 4 is a cross-sectional view of an embodiment of a compressor having lubricant flow paths formed in rotors of the compressor, in accordance with an aspect the present disclosure.

FIG. 4 is a cross-sectional view of an embodiment of the compressor 10, illustrating the male rotor 32 of FIG. 2 and the female rotor 34 of FIG. 3. As shown in the illustrated embodiment, the compressor 10 includes lubricant flow paths that direct the lubricant 63 from the discharge portion 26 to the intake portion 22 of the compressor housing 20.

As discussed above, the axial force 48 may be imposed on the first shaft 50 of the male rotor 32 and/or the second shaft 52 of the female rotor 34 during operation of the compressor 10. The axial force 48 may be generated due to a pressure differential between the ends 31, 33 of the rotors 32, 34 (e.g., near the intake port 28) and the discharge ends 88, 104 of the rotors 32, 34 (e.g., near the discharge port 42). In some embodiments, the axial force 48 imposed on the rotors 32, 34 may be transmitted to the thrust bearing 58, which is disposed radially about at least a portion of the first shaft 50 of the male rotor 32. In some embodiments, the compressor 10 may include thrust bearings 58 disposed radially about at least a portion of both the first shaft 50 of the male rotor 32 and the second shaft 52 of the female rotor 34 (e.g., as shown in FIG. 4). The thrust bearing 58 may counter-act a substantial portion of the axial force 48, such that the axial force 48 does not strain or cause stress to certain compressor 10 components. However, the axial force 48 may reduce an operational or useful life of the thrust bearing 58. As shown in the illustrated embodiment of FIG. 4, the thrust bearing 58 includes an axial contact ball bearing and/or a four-point ball bearing configured to at least partially counter-act the axial force 48.

In some embodiments, a force application device 116, such as a balance piston, is disposed within a portion of the compressor housing 20 (e.g., proximate to the intake portion 22) and is configured to impose the regulating force 60 (e.g., a counter-force) on the first shaft 50, the second shaft 52, or both. As such, in some embodiments, the compressor 10 may not utilize the lubricant 63 (e.g., oil) to provide the regulating force 60 in a direction opposite the axial force 48 on the rotors 32 and/or 34, as described above with respect to FIG. 1.

As set forth above, in some embodiments, the lubricant inlet ports 74 may direct the lubricant 63 toward the discharge portion 26 of the compressor 10 in addition to, or in lieu of, the intake portion 22. For example, the lubricant 63 within the discharge portion 26 may be directed toward various components of the compressor 10, such as the thrust bearing 58 and/or mechanical bearings 65. Excess lubricant 63 and/or used lubricant 63 from the discharge portion 26 may flow into the passageway 66 (e.g., first passageway) of the male rotor 32 and/or the passageway 98 (e.g., second passageway) of the female rotor 34 toward the intake portion 22 of the compressor housing 20. The intake portion 22 may receive the lubricant 63 from the passageways 66, 98 and direct the lubricant 63 toward various components (e.g., mechanical bearings 65) of the compressor 10 to reduce friction between the components and the rotors 32, 34. Positioning the lubricant inlet ports 74 at the discharge portion 26 of the compressor housing 20 instead of at the intake portion 22 may reduce an amount or number of the conduits 78 used to direct the lubricant 63 into the compressor 10. Reducing the amount or number of conduits 78 may reduce maintenance on the compressor 10 by reducing an amount of components subjected to stress and/or strain caused by vibration of the compressor 10 during operation.

Figure 5:
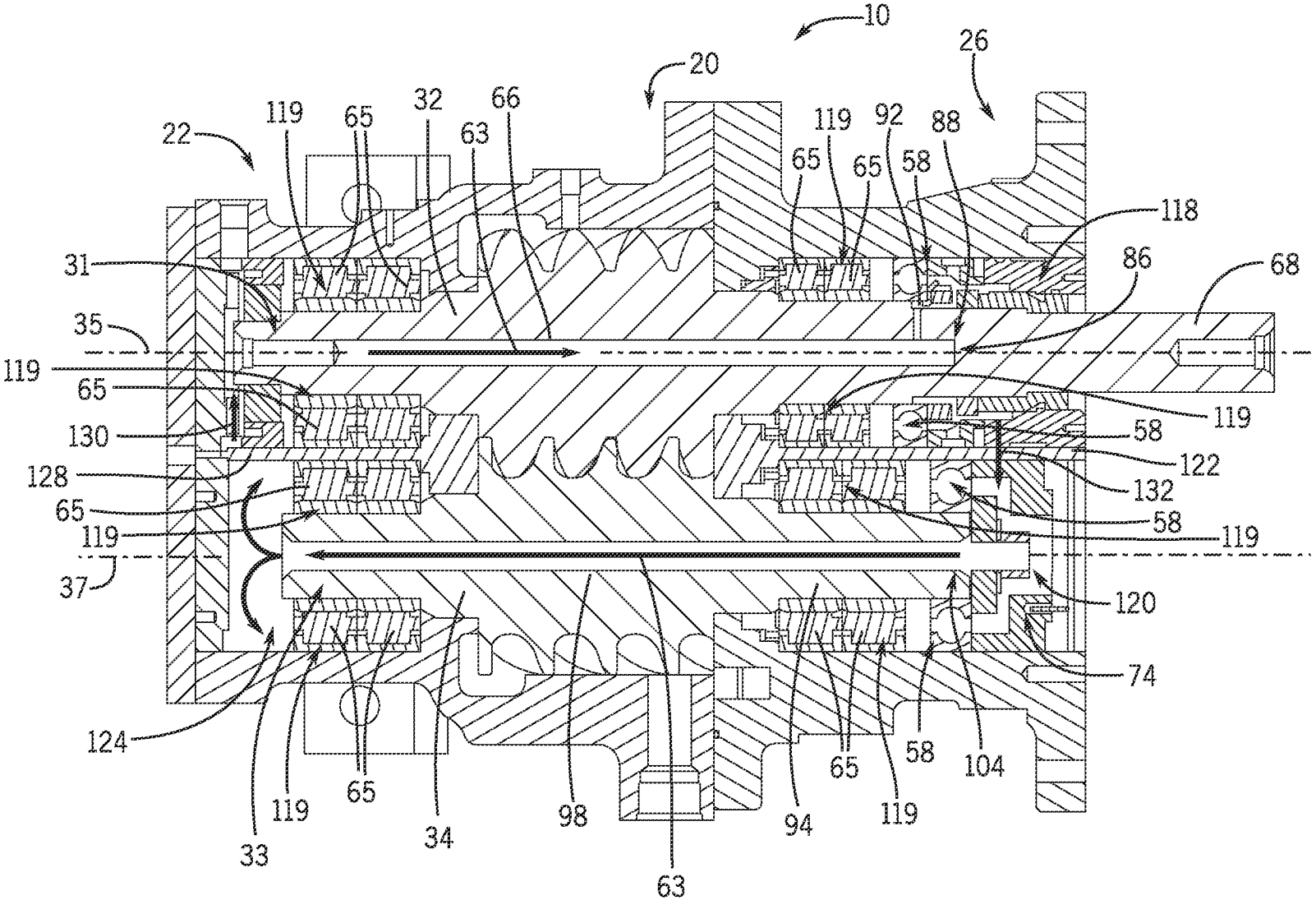
FIG. 5 is a cross-sectional view of an embodiment of a compressor having lubricant flow paths formed in rotors of the compressor, in accordance with an aspect the present disclosure.

FIG. 5 is a cross-sectional view of an embodiment of the compressor 10 that may be utilized in a vapor compression system. As shown in the illustrated embodiment, the compressor 10 may include a dual pass configuration for directing the lubricant 63 toward various components of the compressor 10. As similarly described above, the compressor housing 20 includes the intake portion 22 and the discharge portion 26 fluidly coupled to one another via the first passageway 66 and the second passageway 98 extending through the male rotor 32 and the female rotor 34, respectively. The first passageway 66 extends along the first axis 35 of the male rotor 32 from the end 31 to the portion 86 of the male rotor 32 proximate to the first discharge end 88 of the male rotor 32. The second passageway 98 extends along the second axis 37 of the female rotor 34 from the end 33 of the female rotor 34 to the second discharge end 104 of the female rotor 34. In some embodiments, the discharge portion 26 is fluidly separated into a first discharge portion 118 (e.g., a first lubricant section of the discharge portion 26) that surrounds and/or is otherwise proximate to the first discharge end 88 of the male rotor 32 and a second discharge portion 120 (e.g., a second lubricant section of the discharge portion 26) that surrounds and/or is otherwise proximate to the second discharge end 104 of the female rotor 34. In some embodiments, a barrier 122 (e.g., a plate) may be disposed between the first discharge portion 118 and the second discharge portion 120, such that the lubricant 63 is blocked from flowing between the first and second discharge portions 118, 120.

In the illustrated embodiment, the compressor housing 20 includes the lubricant inlet port 74 that is configured to direct the lubricant 63 into the compressor housing 20 at the second discharge portion 120. The lubricant 63 within the second discharge portion 120 may be configured to lubricate various components (e.g., the thrust bearing 58 and/or the mechanical bearings 65) of the compressor 10 positioned within the second discharge portion 120. The second discharge portion 120 may direct excess and/or used lubricant 63 into the second passageway 98 of the female rotor 34 and toward the intake portion 22. The lubricant 63 received by the intake portion 22 via the second passageway 98 may then lubricate various components (e.g., the mechanical bearings 65) of the compressor 10 within the intake portion 22. In some embodiments, a second barrier 128 (e.g., a plate) may be disposed within the intake portion 22 and may include a channel 130 configured to enable flow of the lubricant 63 from an area of the intake portion 22 axially aligned with the female rotor 34 to an area of the intake portion 22 axially aligned with the male rotor 32. In this way, lubricant 63 received by the intake portion 22 via the second passageway 98 may be directed toward the first passageway 66. A cross-sectional area of the channel 130 may be adjusted (e.g., via a control system, an actuator, etc.) to control the flow of the lubricant 63 between the second passageway 98 and the first passageway 66. In any case, the first passageway 66 may receive the lubricant 63 supplied to the intake portion 22 via the second passageway 98 and may direct the lubricant 63 toward the first discharge portion 118. The first discharge portion 118 may then direct the lubricant 63 toward various components (e.g., the thrust bearing 58 and/or the mechanical bearings 65) of the compressor 10 positioned within the first discharge portion 118 before directing the lubricant 63 out of the compressor housing 20 (e.g., via the lubricant drain port 67).

In other embodiments, the lubricant inlet port 74 may direct the lubricant 63 toward the first discharge portion 118 instead of the second discharge portion 120, such that the lubricant 63 flows into the first discharge portion 118 from the lubricant supply 76, from the first discharge portion 118 to the intake portion 22 via the first passageway 66, from the intake portion 22 toward the second passageway 98, and from the second passageway 98 toward the second discharge portion 120. In still further embodiments, the lubricant inlet port 74 may direct the lubricant 63 into the intake portion 22, as discussed above with reference to FIG. 1. In such embodiments, the second barrier 128 may be sealed (e.g., the channel 130 is sealed), and the barrier 122 may have a second channel 132 to enable lubricant 63 flow between the first discharge portion 118 and the second discharge portion 120. Thus, the lubricant 63 may initially flow into the intake portion 22 and may follow a dual-pass flow path as generally described above.

Figure 6:
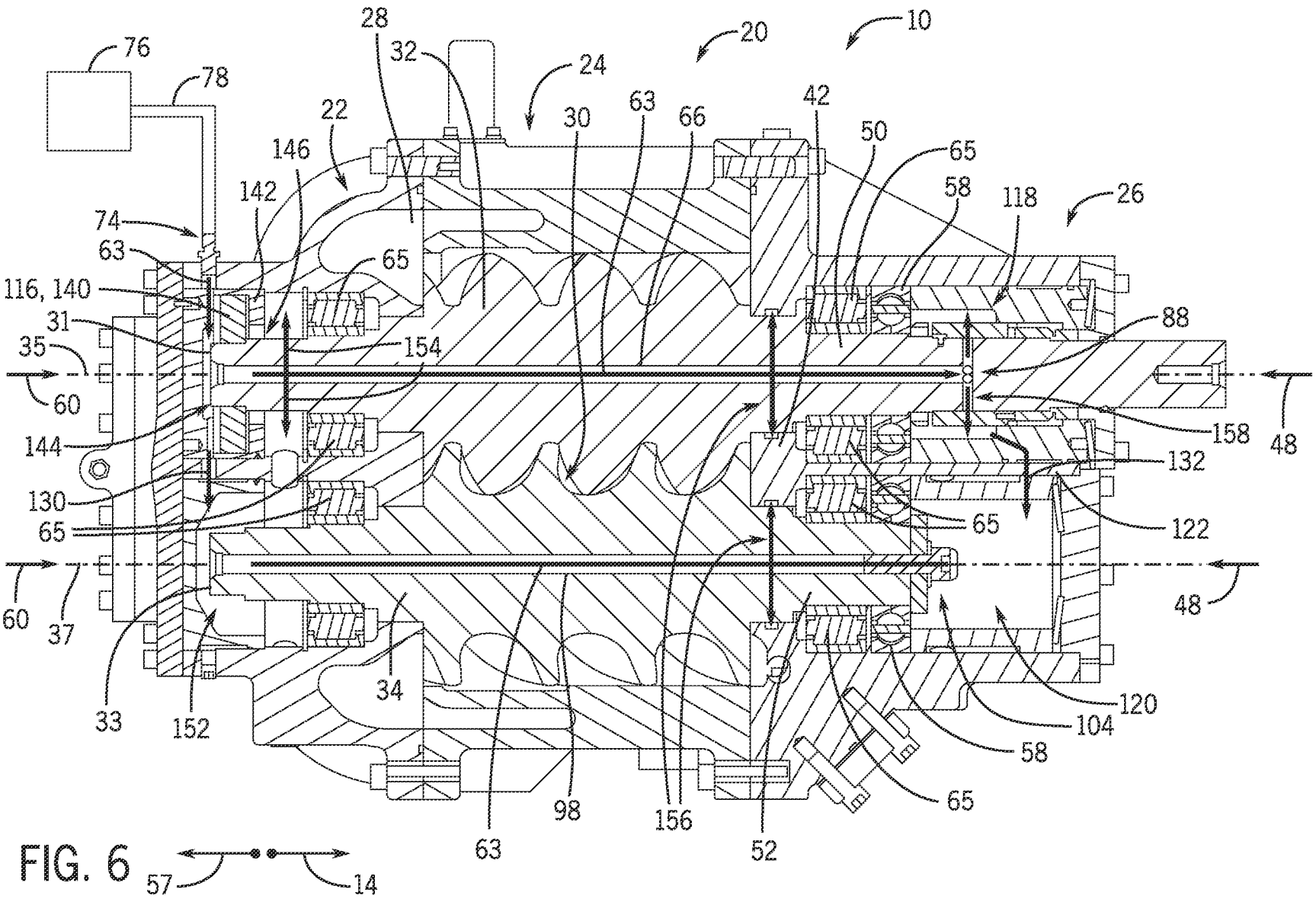
FIG. 6 is a cross-sectional view of an embodiment of a compressor having lubricant flow paths formed in rotors of the compressor, in accordance with an aspect the present disclosure.

FIG. 6 is a cross-sectional view of another embodiment of the compressor 10. As discussed above, the force application device 116 may include a balance piston 140 that may be disposed within the compressor housing 20 (e.g., proximate to the intake portion 22) and configured to impose a portion of or substantially all of the regulating force 60 (e.g., counter-force) on the first shaft 50, the second shaft 52, or both. For example, the balance piston 140 may be disposed within a cylinder 142 (e.g., a sleeve, a chamber or cavity formed within the compressor housing 20), such that the cylinder 142 is divided into a first chamber 144 and a second chamber 146. The first chamber 144 may be in fluid communication with the lubricant inlet 74 and configured to receive a flow of the lubricant 63 from the lubricant supply 76. The second chamber 146 may be in fluid communication with the compression chamber 30 of the compressor 10. In some embodiments, a sealing component of the balance piston 140 may form a fluidic seal between the first chamber 144 and the second chamber 146, such that fluid (e.g., the lubricant 63) is substantially blocked from flowing between the first and second chambers 144, 146. In other embodiments, a small quantity of lubricant 63 may be configured to flow past the balance piston 140, such that the lubricant 63 may lubricate internal components of the compressor 10 (e.g., the mechanical bearings 65, the shafts, 50, 52, the rotors 32, 34). For example, in certain embodiments, an orifice (e.g., a weep hole) formed in the balance piston 140 may enable lubricant 63 to flow from the first chamber 144 to the second chamber 146. The lubricant 63 may be configured to subsequently flow from the second chamber 146 toward any of the aforementioned compressor components. In any case, the lubricant 63 may be used to pressurize the first chamber 144 (e.g., relative to the second chamber 146) to generate a pressure differential across the balance piston 140. As such, the generated pressure differential may enable the balance piston 140 to apply the counterforce 60 to counteract some of or substantially all of the axial force 48.

In some embodiments, lubricant 63 within the first chamber 144 may contact the end 31 of the male rotor 32. The channel 130 between the first chamber 144 and a corresponding chamber 152 of the female rotor 34 may enable lubricant 63 to flow toward and contact the end 33 of the female rotor 34. Accordingly, in accordance with the techniques discussed above, the lubricant 63 may apply a portion of the regulating force 60 to the shafts 50 and 52 that may supplement the portion of the regulating force 60 applied to the shafts 50 and/or 52 by the balance piston 140. That is, the lubricant 63 may apply pressure to the ends 31 and/or 33 of the rotors 32 and/or 34 to counteract some of or substantially all of the axial force 48. As such, the balance piston 140 and/or the lubricant 63 directed toward the ends 31 and 33 of the male rotor 32 and/or the female rotor 34 may reduce the axial force 48 applied to the thrust bearing 58 and, thus, may enhance an operational or useful life of the thrust bearing 58. It should be understood that, in some embodiments, the lubricant 63 may not be directed toward (e.g., contact) the end 31 of the male rotor 32 and/or the end 33 of the female rotor 34.

In the illustrated embodiment, the compressor 10 includes lubricant flow paths (e.g., the passageways 66, 98) that may direct the lubricant 63 from the intake portion 22 to the discharge portion 26 of the compressor housing 20. For example, the first passageway 66 formed in the male rotor 32 may be in fluid communication with the first chamber 144 (e.g., a high pressure chamber) of the balance piston 140. As such, the first passageway 66 may receive lubricant 63 (e.g., high pressure lubricant) from the first chamber 144 and may direct the lubricant 63 along the interior of the male rotor 32 toward the discharge portion 26 of the compressor housing 20. The lubricant 63 may be discharged (e.g., via the radial portions 84) from the first passageway 66 at various locations along the compressor housing 20 (e.g., at first, second, and third locations 154, 156, 158) to lubricate various components (e.g., the mechanical bearings 65) of the compressor 10. In some embodiments, lubricant 63 from the first passageway 66 may discharge into the first discharge portion 118 and may subsequently be directed into the second discharge portion 120 (e.g., via the channel 132). In other embodiments, lubricant 63 within the first discharge portion 118 may be directed into the compression chamber 30 (e.g., near an upstream end of the compression chamber 30), into a suction port of the compressor 10 (e.g., the intake port 28), or toward any other suitable region of the compressor 10.

As noted above, in some embodiments, lubricant 63 may flow through the channel 130 from the first chamber 144 of the balance piston 140 to the chamber 152 located near the end 33 of the female rotor 34. As such, lubricant 63 may sequentially flow from the first chamber 144 into the chamber 152, into the second passageway 98, and through the second passageway 98 (e.g., in the direction 14) from the intake portion 22 toward the discharge portion 26 of the compressor 10. Similar to the male rotor 32 discussed above, it should be understood that the female rotor 34 may be configured to discharge lubricant 63 at a variety of locations along the compressor housing 20 to facilitate lubrication of certain compressor components. Lubricant 63 may discharge from the second passageway 98 into the second discharge portion 120 or to any other suitable region (e.g., the intake port 28, the compression chamber 30) of the compressor 10.

In certain embodiments, the channel 130 may be omitted from the compressor 10. In such embodiments, the lubricant 63 may be configured to flow, from the first chamber 144, into and through the first passage 66 (e.g., in the direction 14), into the first discharge portion 118, into and through the second passage 98 (e.g., in the direction 57), and into the chamber 152. That is, the lubricant 63 may follow a dual-pass flow path through the male and female rotors 32, 34 as generally described above. Indeed, it should be appreciated that the lubricant 63 may be directed through any of the aforementioned lubricant flow passages in multitudinous configurations. The lubricant 63 may drain from the chamber 152 to another suitable location of the compressor 10, such as, for example, the intake port 28, the compression chamber 30, or the lubricant supply 76.

As set forth above, embodiments of the rotors having the lubricant passageways disclosed herein may provide one or more technical effects useful in improving the performance of vapor compression systems. For example, embodiments of the present disclosure are directed toward improved compressor rotors that may increase a compression efficiency of fluid by reducing or removing lubricant within a compression chamber of the compressor. Instead, the lubricant is directed between an intake portion of the compressor and a discharge portion of the compressor through the passageways extending internally through one or more rotors of the compressor. Further, the compressor may include a reduced number of lubricant conduits (e.g., external conduits) that supply the lubricant to the compressor, which may reduce maintenance time and/or costs that may be incurred due to stress or wear on such conduits during compressor operation. In any case, the lubricant may be directed between the intake portion and the discharge portion of the compressor via the passageways extending through the rotors and toward one or more bearings and/or other components of the compressor without mixing with fluid compressed by the compressor. In some embodiments, the lubricant may be further directed toward an end of the one or more rotors of the compressor to apply a counterforce to the one or more rotors in order to reduce wear on thrust bearings of the compressor.

While only certain features and embodiments have been illustrated and described, many modifications and changes may occur to those skilled in the art (e.g., variations in sizes, dimensions, structures, shapes and proportions of the various elements, values of parameters (e.g., temperatures, pressures, etc.), mounting arrangements, use of materials, colors, orientations, etc.) without materially departing from the novel teachings and advantages of the subject matter recited in the claims. The order or sequence of any process or method steps may be varied or re-sequenced according to alternative embodiments. It is, therefore, to be understood that the appended claims are intended to cover all such modifications and changes as fall within the true spirit of the disclosure.

Furthermore, in an effort to provide a concise description of the exemplary embodiments, all features of an actual implementation may not have been described (i.e., those unrelated to the presently contemplated best mode, or those unrelated to enablement). It should be appreciated that in the development of any such actual implementation, as in any engineering or design project, numerous implementation specific decisions may be made. Such a development effort might be complex and time consuming, but would nevertheless be a routine undertaking of design, fabrication, and manufacture for those of ordinary skill having the benefit of this disclosure, without undue experimentation.

The invention claimed is:

1. A compressor, comprising:

a compressor housing including an intake portion configured to receive a fluid, a discharge portion configured to discharge the fluid, and a compression portion disposed between the intake portion and the discharge portion;

a rotor disposed in the compressor housing and configured to compress, within the compression portion, the fluid flowing from the intake portion toward the discharge portion, wherein the rotor comprises:

a body; and an internal passageway formed within the body and extending along an axial length of the rotor, wherein the internal passageway is configured to direct a lubricant between a first end of the rotor proximate the intake portion and a second end of the rotor proximate the discharge portion of the compressor housing, and wherein the internal passageway is fluidly separate from the compression portion; and a balance piston configured to apply a force on the rotor and positioned within the compressor housing between a first chamber of the compressor housing configured to receive a flow of the lubricant and a second chamber of the compressor housing, wherein the first chamber is in fluid communication with the internal passageway and is configured to direct the lubricant into the internal passageway.

2. The compressor of claim 1, wherein the rotor comprises a channel extending radially outward from the internal passageway and through an exterior surface of the rotor.

3. The compressor of claim 2, wherein the channel is configured to direct the lubricant from the internal passageway toward a bearing of the compressor, and/or wherein the channel is configured to direct the lubricant from the internal passageway toward the discharge portion of the compressor housing.

4. The compressor of claim 1, wherein the internal passageway comprises a variable diameter along the axial length of the rotor.

5. The compressor of claim 1, comprising a lubricant supply configured to direct the lubricant into a lubricant passage within the intake portion, wherein the lubricant passage is communicatively coupled to the internal passageway.

6. The compressor of claim 5, wherein the compressor housing comprises a lubricant inlet port configured to receive the lubricant from the lubricant supply, and wherein the lubricant inlet port is communicatively coupled to the internal passageway and disposed in the intake portion.

7. A compressor, comprising:

a compressor housing including an intake portion configured to receive a fluid, a discharge portion configured to discharge the fluid, a compression portion disposed between the intake portion and the discharge portion, and a lubricant inlet port; and a rotor disposed in the compressor housing and configured to compress, within the compression portion, the fluid flowing from the intake portion toward the discharge portion, wherein the rotor comprises:

a body;

lobes and/or grooves configured to contact the fluid during compression; and a passageway extending internally through the body along an axial length of the rotor and through at least portions of the intake portion, the compression portion, and the discharge portion of the compressor housing, wherein the passageway is configured receive a lubricant from the lubricant inlet port, wherein the passageway is fluidly separate from the compression portion, and wherein the intake portion of the compressor housing is configured to receive the lubricant via the lubricant inlet port in order to apply a pressure force in a first direction to an end of the rotor proximate the intake portion and counteract an axial load applied to the rotor in a second direction, opposite the first direction.

8. The compressor of claim 7, comprising a thrust bearing configured to block axial movement of the rotor in the second direction in response to the pressure force being less than, equal to, or greater than the axial load applied to the rotor.

9. The compressor of claim 7, comprising a sleeve bearing disposed about the rotor and configured to block radial movement of the rotor in the compressor housing with respect to an axis extending along the axial length of the rotor, wherein the passageway comprises an outlet configured to direct the lubricant toward the sleeve bearing and between the sleeve bearing and the rotor.

10. The compressor of claim 7, comprising:

a chamber formed in the compressor housing; and a balance piston disposed within the chamber and dividing the chamber into a first chamber and a second chamber, wherein the first chamber is configured to receive the lubricant from the lubricant inlet port, and wherein the passageway is in fluid communication with the first chamber to enable a flow of the lubricant from the first chamber into the passageway.

11. The compressor of claim 7, wherein the passageway comprises one or more outlets configured to direct a flow of the lubricant to one or more bearings of the compressor.

12. A compressor, comprising:

a compressor housing comprising an intake portion configured to receive a fluid, a discharge portion configured to discharge the fluid, and a compression portion disposed between the intake portion and the discharge portion, wherein the intake portion comprises a first chamber configured to receive a lubricant from a lubricant source, a second chamber, and a channel configured to direct the lubricant from the first chamber to the second chamber;

a first rotor disposed in the compressor housing, wherein the first rotor comprises:

a first body; and a first passageway extending through the first body along a first axial length of the first rotor, wherein the first passageway is configured to receive the lubricant from the first chamber of the intake portion and to direct the lubricant between a first end of the first rotor proximate the intake portion and a second end of the first rotor proximate the discharge portion of the compressor housing, wherein the first passageway is fluidly separate from the compression portion, and the first passageway is configured to direct the lubricant toward the discharge portion; and a second rotor disposed in the compressor housing, wherein the second rotor comprises:

a second body; and a second passageway extending through the second body along a second axial length of the second rotor, wherein the second passageway is configured to receive the lubricant from the second chamber of the intake portion and to direct the lubricant between a third end of the second rotor proximate the intake portion and a fourth end of the second rotor proximate the discharge portion of the compressor housing, wherein the second passageway is fluidly separate from the compression portion, and the second passageway is configured to direct the lubricant toward the discharge portion, wherein the first rotor and the second rotor are configured to rotate and engage with one another to compress the fluid flowing from the intake portion toward the discharge portion.

13. The compressor of claim 12, comprising the lubricant source and a lubricant conduit configured to provide the lubricant to the first chamber of the intake portion.

* * * * *